US005292301A

United States Patent [19]

Focke

[11] Patent Number: 5,292,301

[45] Date of Patent: Mar. 8, 1994

[54] PACK FOR CIGARETTES OR THE LIKE AND PROCESS AND APPARATUS FOR THE PRODUCTION THEREOF

[75] Inventor: Heinz Focke, Verden, Fed. Rep. of Germany

[73] Assignee: Focke & Co. (GmbH & Co.), Verden, Fed. Rep. of Germany

[21] Appl. No.: 961,856

[22] Filed: Oct. 16, 1992

Related U.S. Application Data

[62] Division of Ser. No. 690,186, Apr. 19, 1991.

[30] Foreign Application Priority Data

Apr. 26, 1990 [DE] Fed. Rep. of Germany ..... 4013264

[51] Int. Cl.[5] ..... B65H 45/12

[52] U.S. Cl. ..... 493/356; 493/81; 493/167; 493/177

[58] Field of Search ..... 493/69-72, 493/79-81, 167, 174, 177, 183, 356, 357, 437, 438, 453, 457

[56] References Cited

U.S. PATENT DOCUMENTS

| | | | |
|---|---|---|---|
| 1,705,748 | 3/1929 | Bridgman | 493/71 |
| 2,846,929 | 8/1958 | Hickin | 493/168 |
| 2,886,234 | 5/1959 | Toensmeier . | |
| 3,343,464 | 9/1967 | Gross | 493/168 |
| 3,454,149 | 7/1969 | Nigrelli et al. . | |
| 3,673,763 | 7/1972 | Dorfmann . | |
| 3,800,681 | 4/1974 | Corderoy | 493/167 |
| 4,299,073 | 11/1981 | Golicz et al. . | |
| 4,642,967 | 2/1987 | Culpepper . | |
| 4,694,632 | 9/1987 | Gunther, Jr. . | |
| 4,912,910 | 4/1990 | Lowe et al. . | |
| 4,938,656 | 7/1990 | Gamberini et al. . | |
| 5,054,259 | 10/1991 | Miller et al. . | |

FOREIGN PATENT DOCUMENTS

| | | |
|---|---|---|
| 488769 | 1/1930 | Fed. Rep. of Germany . |
| 508538 | 9/1930 | Fed. Rep. of Germany . |
| 585258 | 2/1947 | Fed. Rep. of Germany . |
| 1696067 | 10/1954 | Fed. Rep. of Germany . |
| 1074385 | 1/1960 | Fed. Rep. of Germany . |
| 1144643 | 9/1963 | Fed. Rep. of Germany . |
| 1906965 | 10/1964 | Fed. Rep. of Germany . |
| 1194314 | 6/1965 | Fed. Rep. of Germany . |
| 7119018 | 5/1971 | Fed. Rep. of Germany . |
| 7625899 | 8/1976 | Fed. Rep. of Germany . |
| 7629556 | 9/1976 | Fed. Rep. of Germany . |
| 8002488 | 1/1980 | Fed. Rep. of Germany . |
| 3150447 | 6/1983 | Fed. Rep. of Germany . |
| 3522614 | 1/1987 | Fed. Rep. of Germany . |
| 3819874 | 1/1989 | Fed. Rep. of Germany . |
| 3727489 | 3/1989 | Fed. Rep. of Germany . |
| 346026 | 12/1989 | Fed. Rep. of Germany . |

*Primary Examiner*—Jack Lavinder
*Attorney, Agent, or Firm*—Sughrue, Mion, Zinn, Macpeak & Seas

[57] ABSTRACT

A pack for cigarettes and a process and apparatus for the production thereof is described. Due to several reasons (cigarette) packs quite often have greater (inner) dimensions than the pack contents (cigarette block 23). In order to fill a cavity formed hereby within the pack, a filling piece (39) is provided which is formed from a flat blank (40) folding up outer blank portions. The filling piece is formed to have a three-dimensional shape by being displaced in a folding shaft (57) with laterally arranged folding members. The filling pieces (39) produced in this way are conveyed along a filling piece track (78) and are introduced into a block track (79) in transverse direction so they can each be united with a cigarette block (23).

7 Claims, 10 Drawing Sheets

FIG.1A
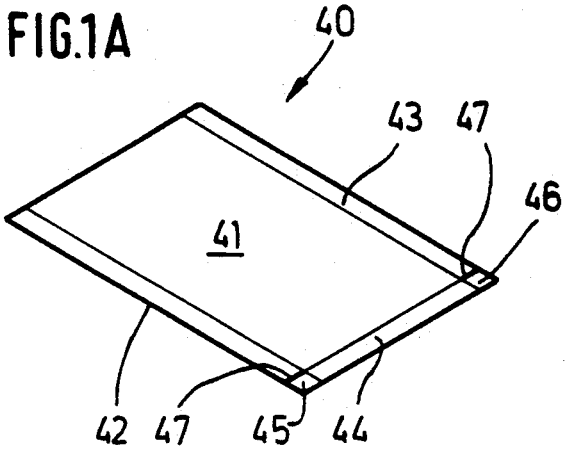
FIG.1D
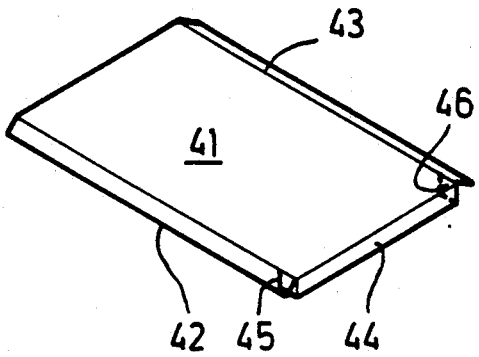
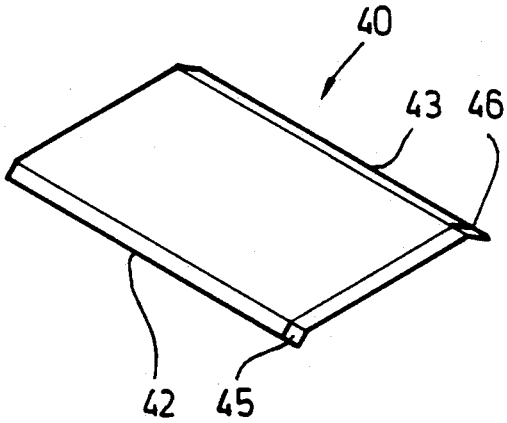
FIG.1B
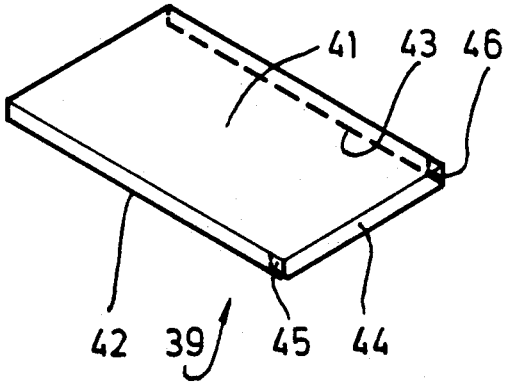
FIG.1E
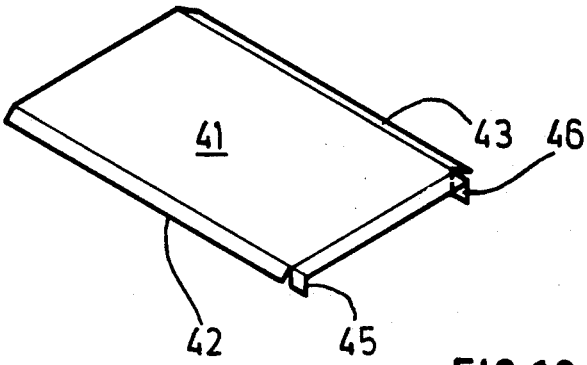
FIG.1C

PACK FOR CIGARETTES OR THE LIKE AND PROCESS AND APPARATUS FOR THE PRODUCTION THEREOF

This is a division of application Ser. No. 07/690,186, filed Apr. 19, 1991.

BACKGROUND OF THE INVENTION

The invention relates to a cuboidal pack made of (thin) cardboard, especially a hinge lid box for accommodating a group of cigarettes wrapped in an inner blank (cigarette block), the dimensions of said group of cigarettes being smaller in depth than the depth of the pack, with a filling piece being arranged in a cavity formed hereby within the pack, said filling piece consisting of (thin) cardboard, and with a filling piece wall abutting the pack contents (cigarette block), and with upright side panels and an upper cross-panel folded transversely relative to said filling piece wall. The invention furthermore relates to a process for producing the filling piece and for introducing the same into a pack. Finally, the invention relates to an apparatus for conducting said process.

Hinge lid boxes are used world-wide as cigarette packs. The structure of this pack type is mostly standardized. This applies to the dimensions as well. Any changes in size have far-reaching consequences. Vending machines for cigarette packs would for instance have to be altered. In some countries, revenue markings are stamped on the packs. The stamping machines are designed for standard pack dimensions.

On the other hand, cigarettes with a substantially smaller diameter than standard cigarettes are increasingly introduced. Consequently, an identical number of such cigarettes forms a pack filling, i.e. cigarette block, with a smaller dimension. The arrangement is mostly such that the cigarette block has a smaller depth then the inner space of the hinge lid box. As a result, a cavity is formed within the pack which is (partially) filled by filling pieces made of foamed material or corrugated cardboard.

Known in the art is also a pack of the aforementioned type, in which the filling piece facing the rear wall consists of three-dimensionally folded (thin) cardboard. The filling piece is part of a blank for a collar which is commonly used with packs of this type. The filling piece is connected with the collar blank and comprises a filling piece wall, transversely folded side panels and an upper crosspanel which is also transversely folded (EP-A-346 026).

By forming a uniform and single-piece blank from collar and filling piece, this known proposal requires a considerable expenditure of material, even more so since the portion of the blank designed for forming the collar is considerably larger than in ordinary packs. Moreover, the production of the pack, especially of the filling piece, and the filling of the pack is more complicated and disadvantageous in terms of machine technics.

Setting out from this state of the art, the invention is based on the object to further develop and improve a pack of the aforementioned kind, such that filling pieces made of folded (thin) cardboard can be simply produced and accomodated in the pack in a material-saving manner.

SUMMARY OF THE INVENTION

To attain this object, the pack according to the invention is characterized in that at least upper corner tabs extending as an extension of the (upper) cross-panel are severed by severing cuts from the adjoining side panels and are folded to a supporting position transverse to the filling piece wall and at right angles to the cross-panel.

The corner tabs and their folding position as taught by the invention effect a significantly higher stability of the filling pieces formed by folded thin cardboard within the pack. In particular, the loading capacity of the upper portion of the filling piece can be increased without any adhesive bonding. The outstanding feature of the invention is that as a result of the folding position of the corner tabs, the upper cross-panel of the filling piece is held in a stable and rigid position. The corner tabs wedged in between the pack contents (cigarette block) and the adjacent pack wall (rear wall) prevent the upper cross-panel from folding back or even just tilting away from the transverse supporting position. Moreover, the corner tabs ensure a particularly stable corner structure of the filling piece.

The filling piece as taught by the invention can be produced by means of a simple process. After a severing cut has been applied between corner tabs and adjoining side panels, the corner tabs are folded to a position transverse to the remaining portion of the blank and to the crosspanel. Then, said cross-panel is folded into the supporting position (transverse to the filling piece wall). Finally, the side panels are folded into the supporting position which is also transverse to the filling piece wall. As a result, the corner tabs are located on the inside of the side panels. When the filling piece is in filling or supporting position within the pack, the width of the filling piece wall corresponds to the width of the cavity which is to be filled. Thus, all folded portions are retained in the proper filling piece position by pack walls and by locking themselves.

According to the invention, the filling pieces are folded from a flat blank, specifically by being moved relative to stationary folding means (folding edges).

After being finished, the filling piece is fed to a preferably rectilinear pack track via a special form-stabilizing filling piece track. The folded filling pieces are held ready in the region of the pack track below the plane of movement of the pack contents (cigarette block) and are taken along therewith to a pack, that is to say to a folding turret. Then, cigarette block and filling piece can be packed in the customary way as a unit, for example in an apparatus according to DE-PS 24 40 006.

Further details of the invention relate to the structure and production of the filling piece and to feeding same to the pack contents. An exemplary embodiment of the filling piece and of an apparatus for producing and installing same are described below in more detail with reference to the drawings, in which:

BRIEF DESCRIPTION OF THE INVENTION

FIG. 1*a* to FIG. 1*e* show folding steps for the production of a filling piece from a blank, FIG. 2 is a top plan view of an open pack (hinge lid box) with filling piece on a highly enlarged scale, FIG. 3 shows a vertical section of the pack according to FIG. 2 in closed position, on a reduced scale, FIG. 4 is a perspective view of details of an apparatus for producing filling pieces and for feeding same to a cigarette block, FIG. 5 is a side view and longitudinal section of the apparatus according to FIG. 4, FIG. 6 shows a detail of the apparatus according to FIG. 5 on an enlarged scale, FIG. 7 is a plan view of the apparatus according to FIG. 5, FIG. 8 is a cross-section of the apparatus taken along line VIII—VIII of FIG. 7, on an enlarged scale, FIG. 9 is a longitudinal section of a conveying track for cigarette blocks taken along the line IX—IX in FIG. 7, FIG. 10 shows a view in analogy to FIG. 9, but with a different relative position.

DETAILED DESCRIPTION OF PREFERRED EMBODIMENTS

Figure 2:
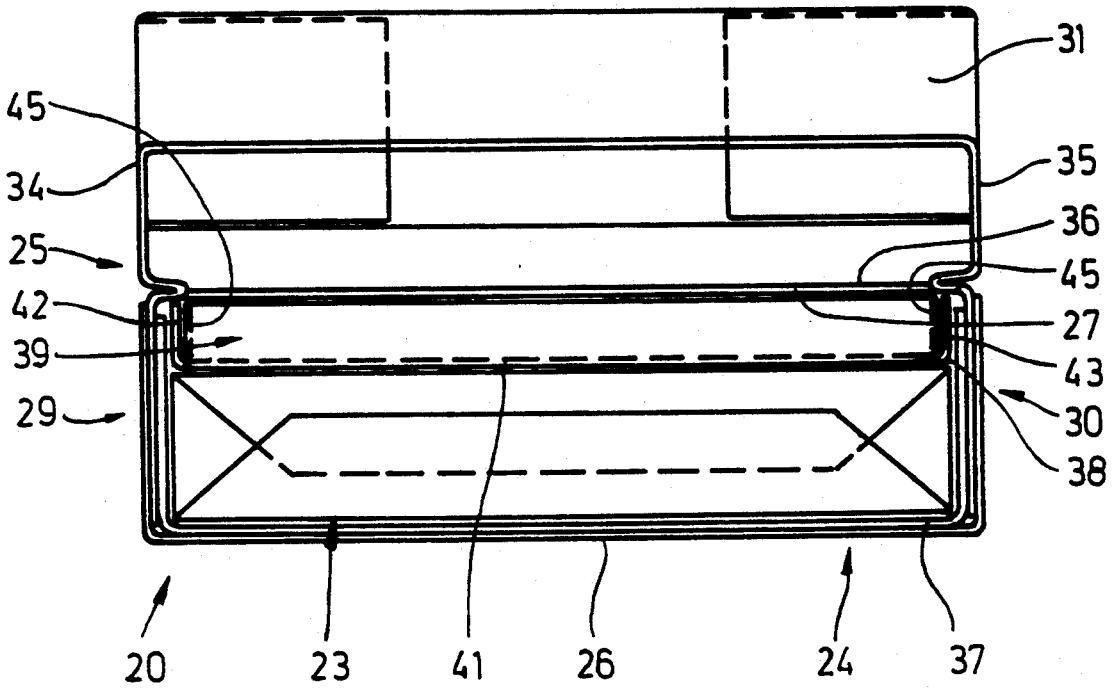
Figure 3:
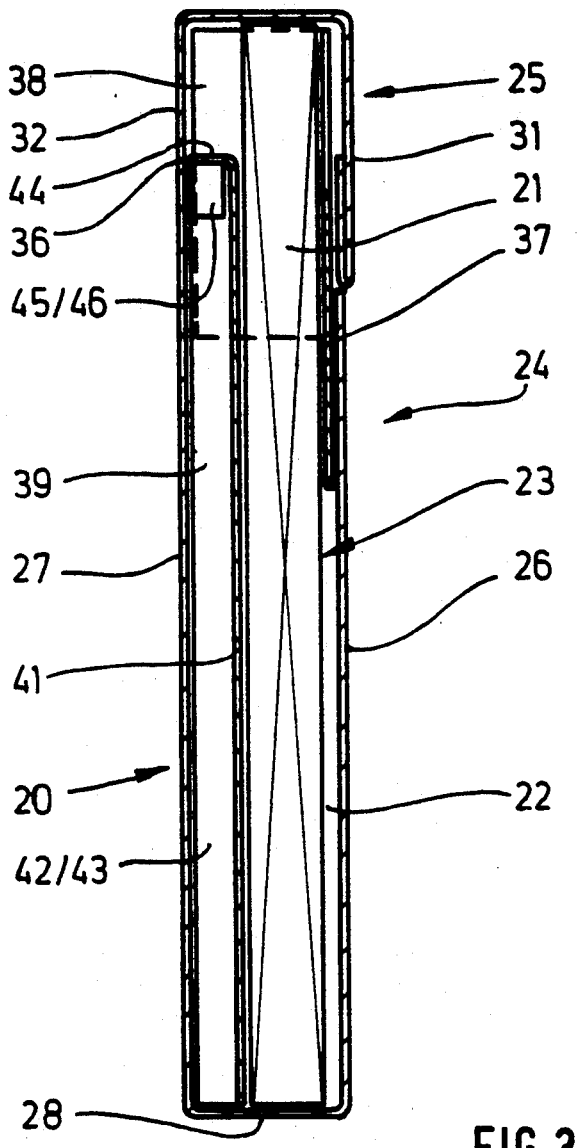
Figure 4:
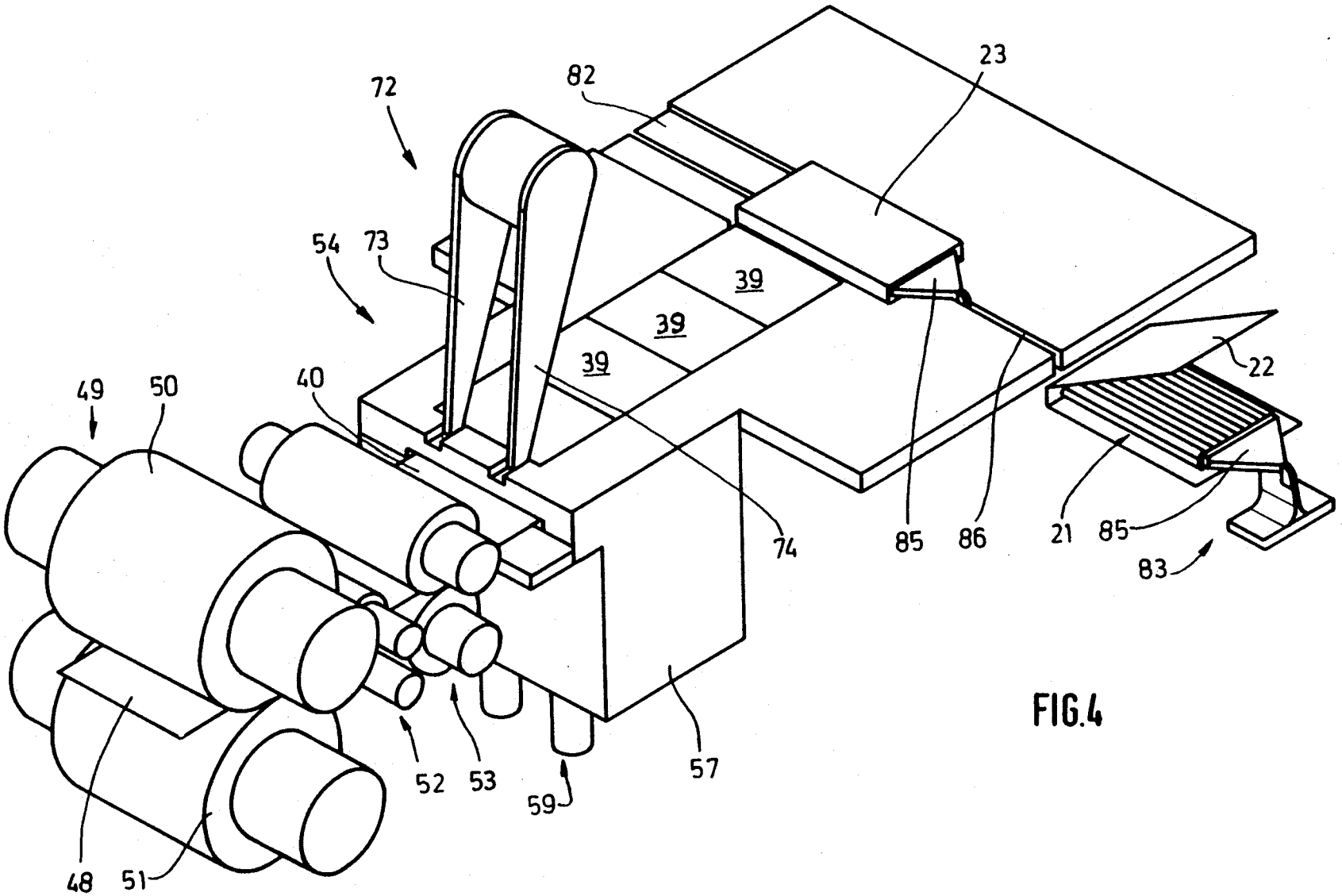
Figure 5:
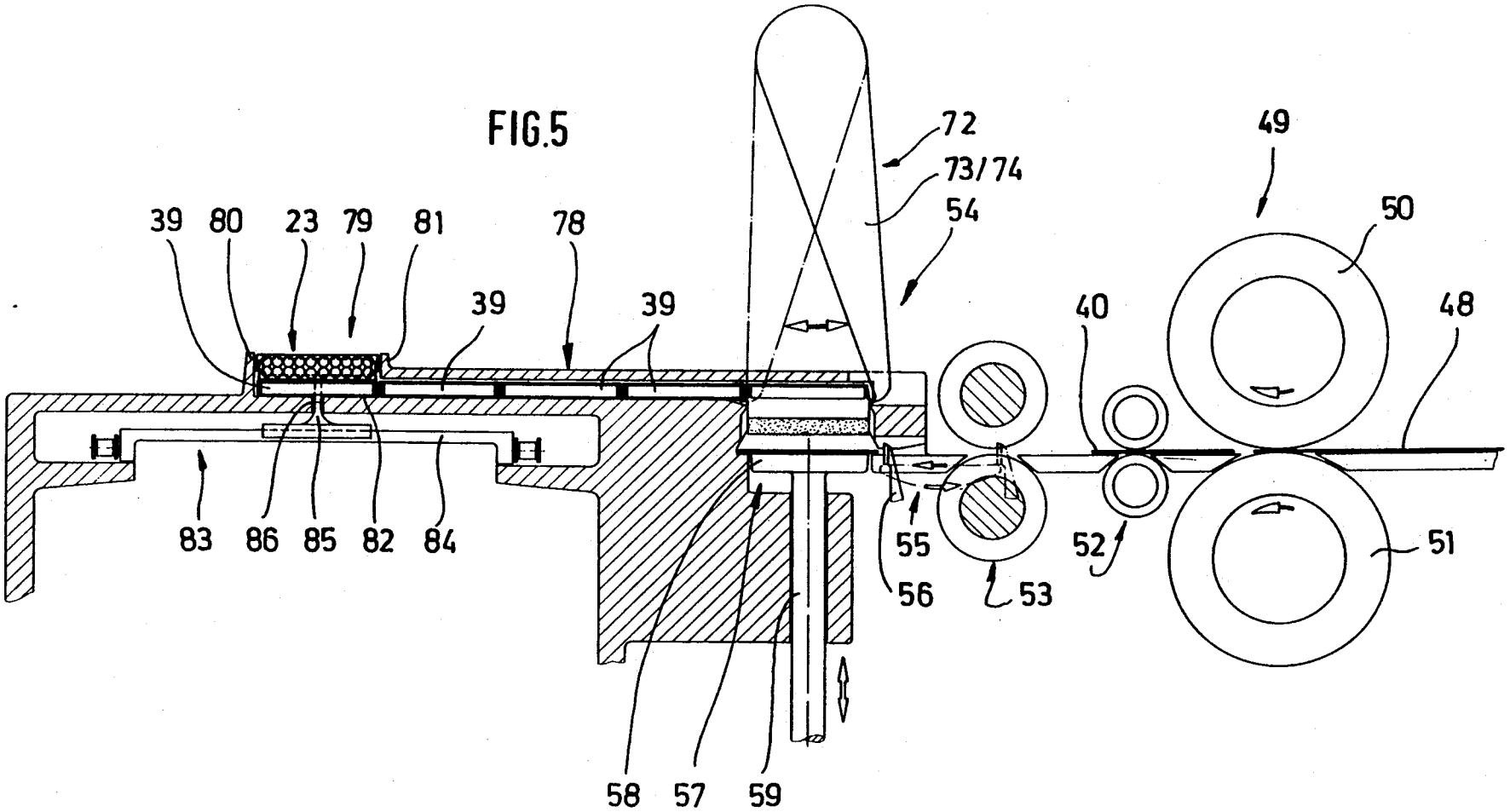

The drawings relate to details in connection with hinge lid boxes 20, as they are known for accommodating a cigarette group 21. The cigarette group 21 is wrapped in an inner blank 22 made of tin foil or the like. The resulting unit is a cigarette block 23 forming the pack contents.

The pack, i.e. the hinge lid box, consists of a box part 24 and a lid 25 pivotably attached thereto.

The box part 24 comprises a front wall 26, a rear wall 27, a bottom wall 28 and side walls 29 and 30. The lid 25 comprises lid front wall 31, lid rear wall 32, lid top wall 33 and lid side walls 34 and 35. The lid rear wall 32 is connected to the rear wall 27 of the box part via a hinge 36. A standard hinge lid box also comprises a collar 37 which is located in the box part 24 in the region of front wall 26 and side walls 29, 30 and which projects from the box part 24.

The hinge lid box 20 is dimensioned such that the inner space of the box is larger than the dimensions of the pack contents (cigarette block 23), so that a cavity 38 is formed within the hinge lid box. In the present case, the cigarette block 23 is facing towards the front wall 26, so that the cavity 38 is formed in the rear part of the hinge lid box 20. The cavity 38 extends across the full height and width of the hinge lid box.

Within the cavity 38 there is a filling piece 39 for (partially) filling out the cavity 38. In the shown embodiment, the filling piece 39 extends across the full width of the cavity 38, i.e. of the inner space of the hinge lid box 20, but only across part of its height. The filling piece 39, standing on the bottom wall 28, extends (approximately) up to the hinge 36, i.e. approximately across the full height of the rear wall 27. Depth and width of the filling piece 39 correspond to the dimensions of the cavity 38, so that the cigarette block 23 is fixed within the hinge lid box 20 by the filling piece 39.

The filling piece consists of a folded blank 40 made of (thin) cardboard. In the initial position (Fig. 1*a*), the blank (40) has a rectangular shape. Folded to its three dimensional shape (FIG. 1*e*), the filling piece 39 forms a filling piece wall 41, approximately corresponding to the size of the rear wall 27 (in the hinge lid box 20). On the upright sides of said wall, side panels 42 and 43 being directed transverse to the filling piece wall 41 are formed. The upper limitation consists of a cross-panel 44 which is also folded transverse to the filling piece wall 41. In the present embodiment, side panels 42, 43 and cross-panel 44 are bearing against the rear wall 27 of the hinge lid box 20. The filling piece wall rests against the pack contents.

Corner tabs 45, 46 have a particular significance. They extend as an extension of the cross-panel 44 in the region of the side panels 42, 43. The corner tabs 45, 46 are separated from the side panels 42, 43 by a severing cut 47.

When the filling piece 39 is in its folded three-dimensional shape, the corner tabs 45, 46 have a special function. They are folded into a position transverse to the filling piece wall 41 and transverse to the cross-panel 44 and they rest against the inside of the side panels 42, 43 in the upper region thereof. As a result, the folding position of the corner tabs 45, 46 is stable, as the folded side panels 42, 43 prevent the corner tabs 45, 46 from moving sideways. The corner tabs 45, 46 are not movable in their plane either, since they are bearing with their (upright) edges against the filling piece wall 41 as well as against the rear wall 27. Without adhesive bonding, the filling piece 39 thus receives a stable and pressure-withstanding shape in folded position for accurately positioning and supporting the cigarette block 23 within the larger hinge lid box 20.

The filling piece 39 is produced by folding the blank 40 in simple successive folding steps which are conducted continuously. First, the side panels 42, 43 are folded with the corner tabs 45, 46 to an inclined intermediate position, at an obtuse angle to the plane of the filling piece wall 41 (FIG. 1*b*). Then, the corner tabs 45, 46 are folded to a position transverse to the plane of the filling piece wall 41 and the cross-panel 44 (FIG. 1*c*). Now, the cross-panel 44 is folded to its supporting position (transverse to the filling piece wall 41; FIG. 1*d*). Herewith, the corner tabs 45, 46 reach their final position. Finally, the side panels 42, 43 are folded to their final position transverse to the filling piece wall 41 (FIG. 1*e*).

The filling pieces 39, designed in the described—or in a different—way, are produced and directly conveyed further to the pack, i.e. to the separately produced or prepared cigarette blocks 23, by means of the apparatus shown in the drawings. A unit formed by cigarette block 23 and filling piece 39 is then fed to a packaging machine and introduced into a partially folded hinge lid box 20. The apparatus for producing the hinge lid box 20 may for instance be made like the apparatus shown in DE-A-24 40 006.

The blanks 40 are severed from a continuous web of material 48, specifically by means of a continuously operating punching and embossing unit 49 which consists of punching and embossing rollers 50, 51 between which the web of material 48 is fed through. The blanks 40 severed from the web of material 48 correspond to the embodiment shown in FIG. 1*a*, i.e. they have severing cuts 47 and embossments for folding side panels 42, 43 and cross-panels 44.

The blanks 40 are fed to a folding station 54 by pairs of conveying rollers 52 and 53. The conveying rollers 52 are driven such that they accelerate the severed blanks 40 relative to the web of material 48. The conveying rollers 53 effect another acceleration. For being fed into the folding station 54, the blanks are taken along by a continuously rotating blank conveyor 55 which comprises one (or more) carriers 56 which engage the blanks 40 at their rear side. These carriers 56 are moved along a two-dimensional path underneath the conveying plane of the blanks and with their returning movement move back into initial position.

The blanks 40 are conveyed by the blank conveyor 55 into a folding shaft 57 of the folding station 54. Said folding shaft 57 is (nearly completely) surrounded by walls with folding means. The blanks 40 are each deposited on a lifting plate 58 of an up and downwardly movable stamp 59. The lifting plate 58 is provided with lateral folding edges 60, 61 which in the upward movement of the lifting plate 58 (with blank 40) interact with stationary folding means.

In a first folding step during the continuous and constant upward movement of the lifting plate 58, the side panels 42, 43, including the corner tabs 45, 46, are folded into the inclined position as shown in FIG. 1*b*. For this purpose, inclined folding surfaces 62, 63 are arranged in the lower region of the folding shaft 57 on opposite sides. In the course of the upward relative movement, said lateral portions of the blank 40 are folded around the folding edges 60, 61 into a downwardly directed inclined position. The side panels 42, 43 (including corner tabs 45, 46) laterally project from the effective surface of the lifting plate 58.

As the lifting plate 58 continues to move up, the side panels 42, 43 being in inclined folding position enter the region of an indentation 64, 65 on both sides of the folding shaft 57. The lateral limitations of these indentations 64, 65 are designed such that the side panels 42, 43 slide along upright guide surfaces 66 while maintaining their inclined position.

Next to the indentations 64, 65, namely in the region of the corner tabs 45, 46 which are also projecting from the effective surface of the lifting plate 58, the inclined folding surfaces 62, 63 continue. They merge into upright side faces 67, 68 which are located only in the narrow region of the corner tabs 45, 46. The correspondingly longer folding surfaces 62, 63 cause the corner tabs 45, 46 to fold from the folding position as shown in FIG. 1*b* to the transverse folding position as shown in FIG. 1*c*. In this position, the corner tabs 45, 46 move upward and slide along the side surfaces 67, 68.

A transversely directed inclined folding surface 69 forming a lateral limitation of the folding shaft 57 serves for folding over the cross- panel 44 to the position as shown in FIG. 1*d*. The folding surface 69 extends in the lower region between the side faces 67, 68. This means that the folding step for the cross-panel 44 commences immediately after the corner tabs 45, 46 have been folded to the position as shown in FIG. 1*c*.

The above folding process is finished when the blank 40 reaches the region of further inclined folding surfaces 70, 71. These are arranged as extensions of the guide surfaces 66 for the side panels 42, 43 and cause the (inclined) side panels 42, 43 to fold over into their final position as shown in FIG. 1*e*. These folding surfaces 70, 71 reduce the folding shaft 57 in its upper region to the dimensions of the folded filling piece 39. The folded lateral blank portions surround the edges of the lifting plate 58.

The ready-folded filling pieces 39 are conveyed by the stamp 59 to an upper slide-off position. They are located in the path of movement of a slide means. In the shown embodiment, a slide lever 72 which is movable to and fro, i.e. pivotable, is provided. Here, this slide lever 72 has a double-arm design with two spaced apart webs 73, 74 for commonly engaging the filling pieces 39 at their rear side in slide-off direction. The lower ends of the slide lever 2 or the webs 73, 74 thereof have a hook-like shape, so that a lower short leg 75 engages and supports the filling pieces 39 at their bottom side while they are discharged.

Figure 6:
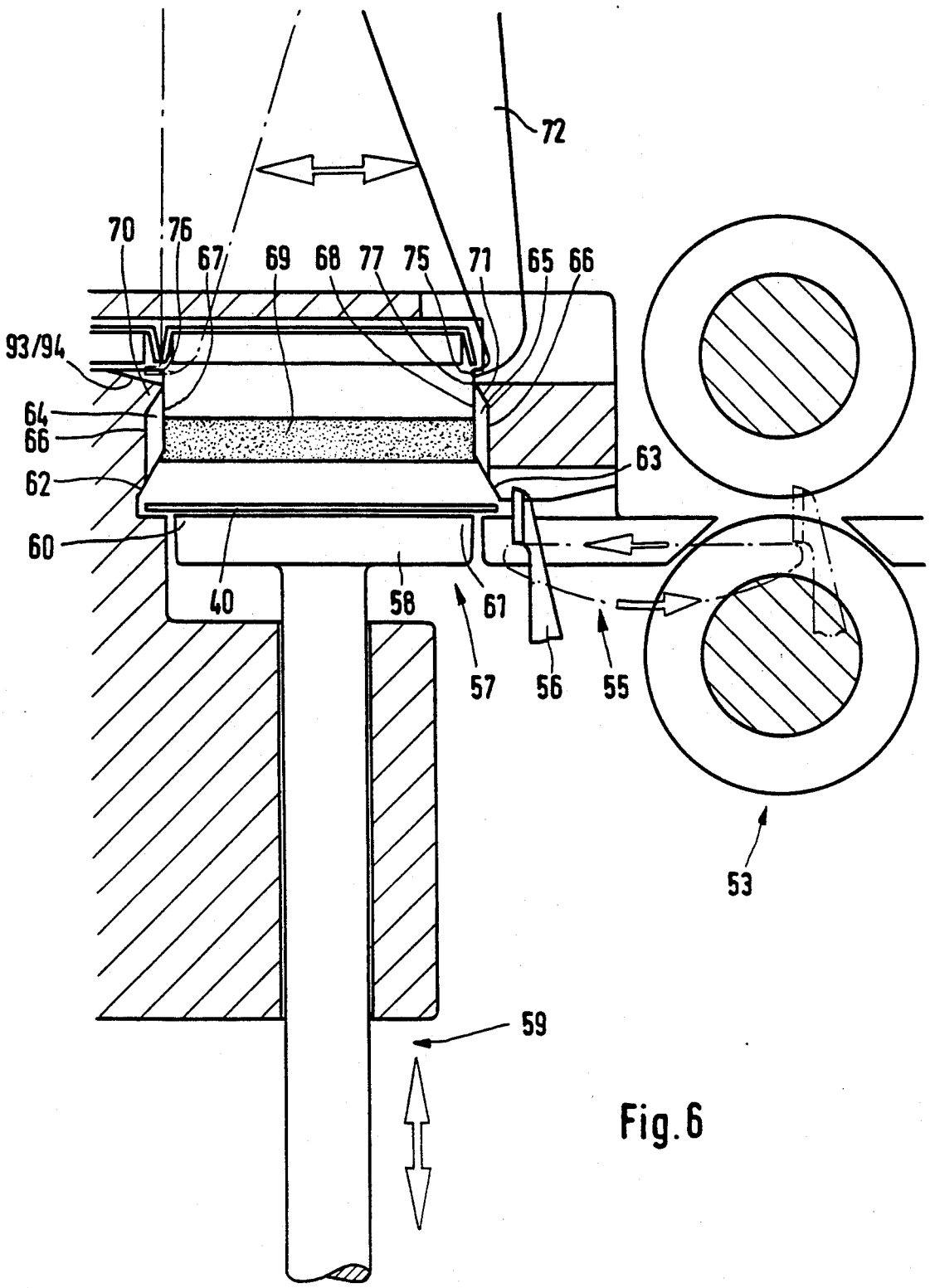
Figure 7:
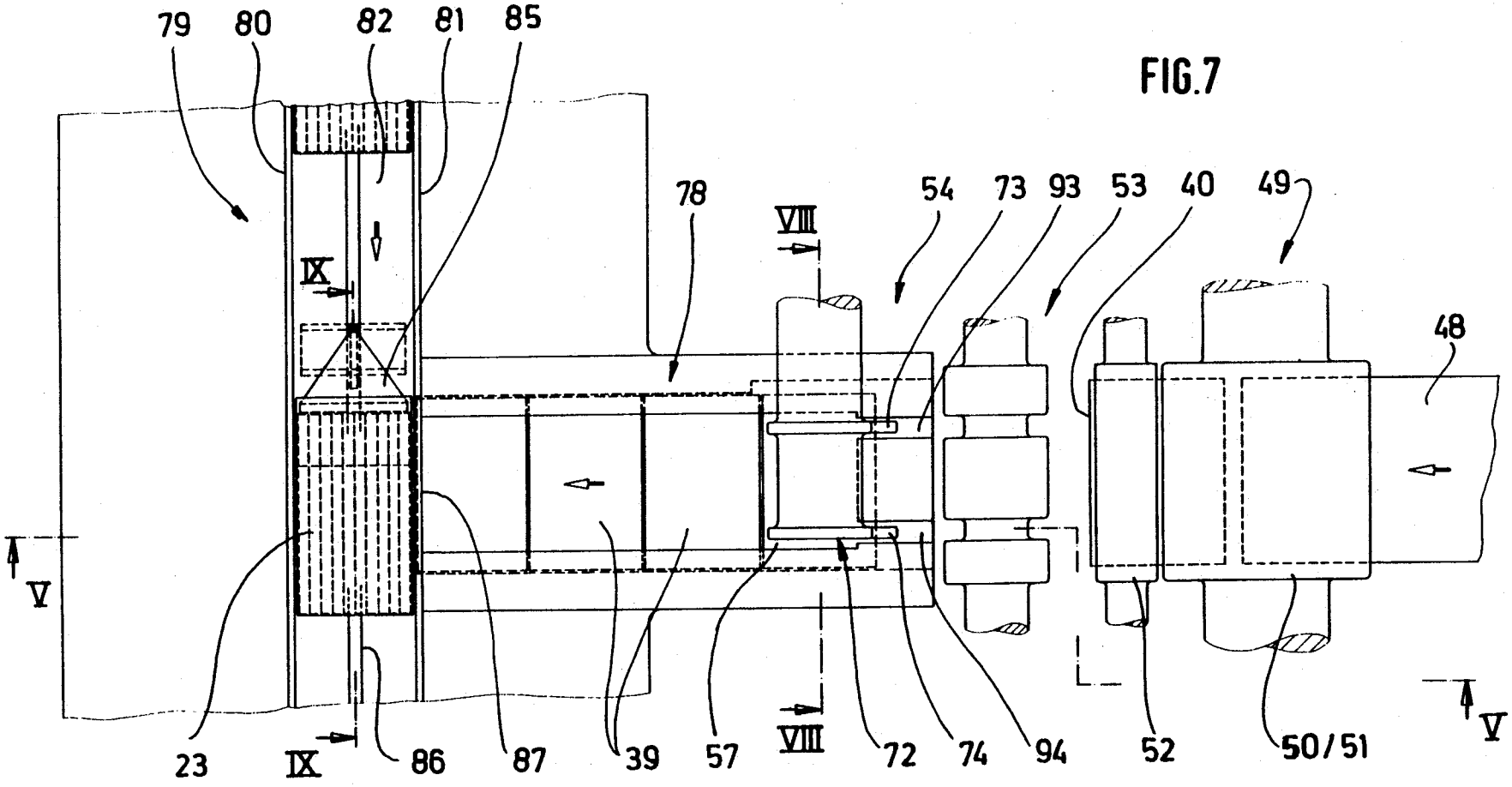
Figure 8:
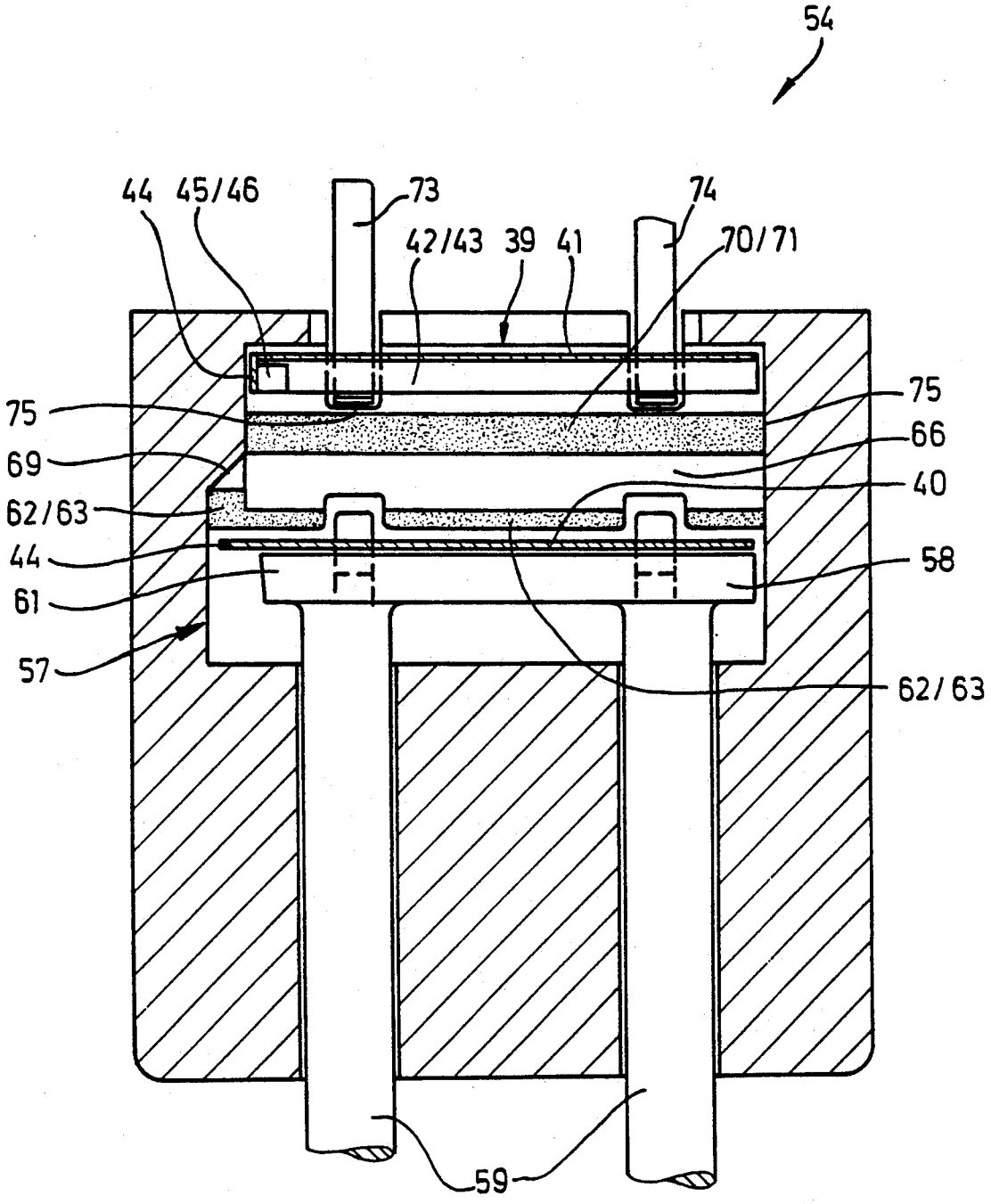
Figure 9:
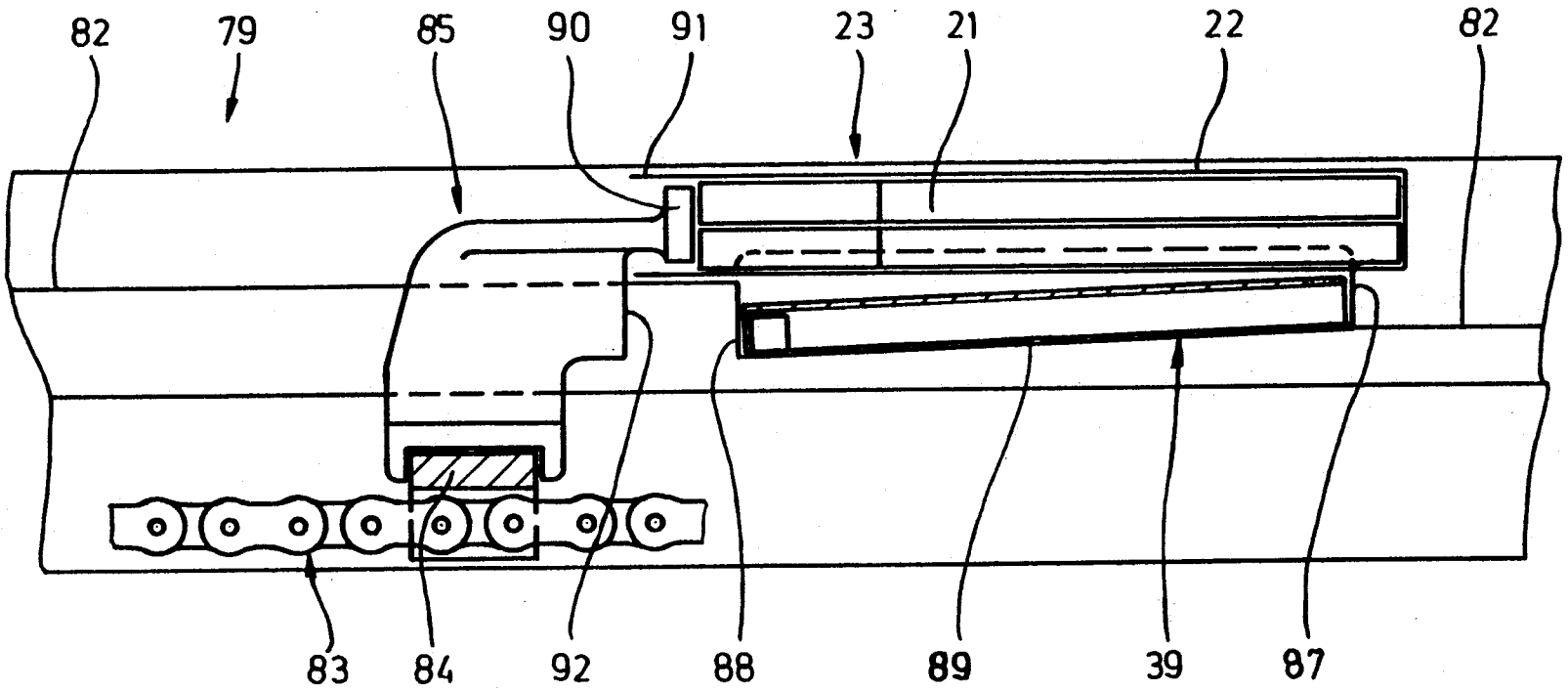

The slide lever 72 can be moved by one conveying cycle at a time, each cycle corresponding to the width of a filling piece 39 (measurement in the direction of discharge). In this process, lower parts of the webs 73, 74 of the slide lever 72 enter slot-like recesses 93, 94 of the lateral limitations of the folding shaft 57, specifically on both opposite sides of the folding shaft 57. After each slide cycle, the upper part of the folding shaft 57 becomes vacant, so that the described folding process can again be conducted with the following blank after the stamp 59 has been lowered. As a result of the restoring stress of the material in the folded portions of the filling pieces 39, the side panels 42, 43 are in a slightly inclined position (FIG. 6) in which they bear against supporting edges 76, 77 at the upper end of the folding shaft 57. Thus, the stamp 59 can be moved downwards without taking along the filling piece.

The filling pieces 39 are conveyed by the slide lever 72 from the region of the folding shaft 57 into a filling piece track 78 consisting of a channel which has the same cross-sectional dimensions as the filling piece 39 and which is preferably closed on all sides. As a result, the folded filling pieces 39 are secured in folded shape during transport. Transport is conducted in cycles by one filling piece 39 at a time. A tightly arranged row is pushed forward, with a new filling piece 39 being pushed into the filling piece track 78 by the slide lever 72.

The filling piece track 78 extends transversely to a block path 79 which serves for (continuously) transporting the pack contents, i.e. in this case cigarette blocks 23. The block track 79, which in the present embodiment is upwardly open, is limited by lateral track guides 80, 81. A rotating conveyor is operating in the region of a track bottom 82, namely a chain conveyor 83 having carriers 85 arranged on traverses 84, said carriers engaging the rear side of one pack filling (cigarette block 23) at a time. The carriers 85 pass through a long slot 86 in the track bottom 82.

The filling piece track 78 laterally opens out into the block track 79, specifically with a track opening 87 having a greater vertical dimension than the filling piece 39. The block track 79 is designed such that up to the track opening 87 for the filling pieces 39, the track bottom 82 is located on a raised level, such that the incoming cigarette blocks 23 can be conveyed over and across the respective filling piece 39 in the region of the track opening 87. Here, the track bottom 82 forms a step 88 which the filling piece 39 abuts. The track bottom 82 is downwardly offset in the vertical direction in this region and forms an inclined surface 89 on which the filling piece 39 rests in a respective position, namely at an acute angle relative to the plane of movement of the cigarette block 23, rising in the conveying direction. The arrangement has been designed such that the filling piece rests below the plane of the track bottom 82 with the side (cross-panel 44) which is pointing towards the incoming cigarette block 23. The oppositely situated side of the filling piece 39 lies with its upper side directly in the plane of movement of the cigarette block 23 so that the filling piece 39 can be taken along by the continuously conveyed cigarette block 23 without jamming.

Figure 10:
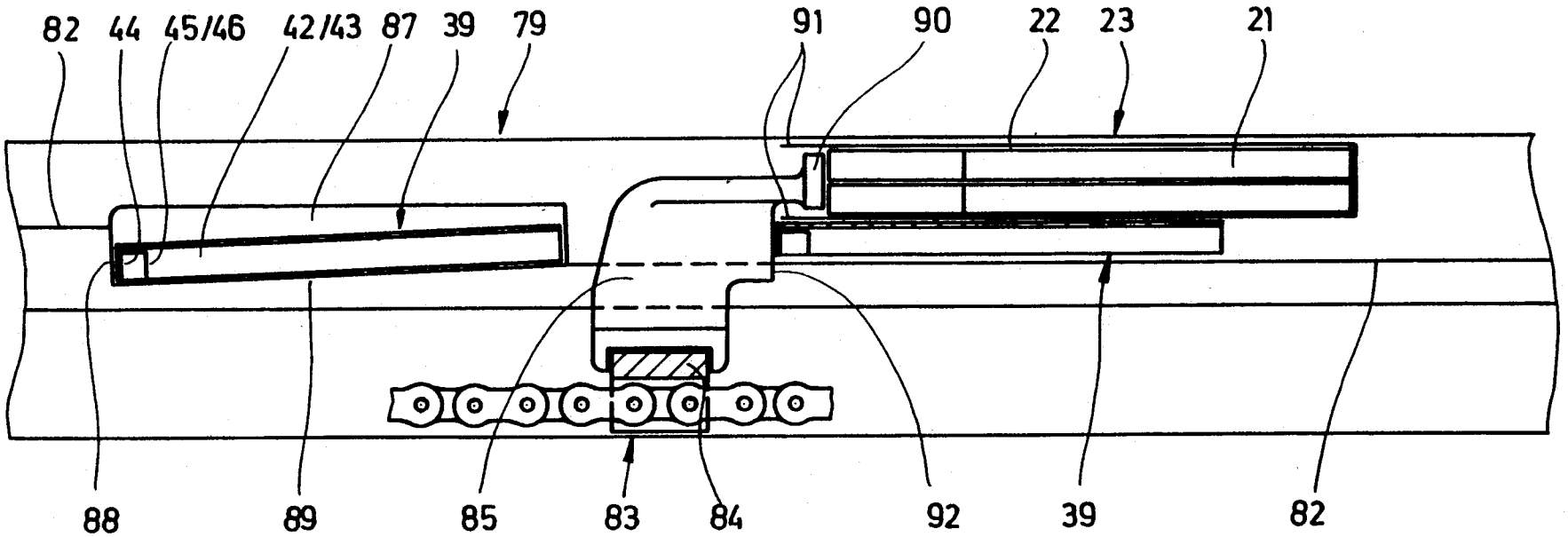

In the shown embodiment, the filling piece 39 is engaged below the cigarette block 23 by the carrier 85 of the chain conveyor 83 which is assigned to the cigarette block 23. Then, the unit consisting of cigarette block 23 and filling piece 39 is conveyed by the carrier 85 (FIG. 10).

The carrier 85 is designed in a special way. A ram head 90 engages the rear side of the cigarette block 23 or cigarette group 21. At this point, the cigarette block 23 is not yet finally folded. Rearward folding tabs 91 serving for forming an upper end fold of the inner blank 22 still project from the rear of the cigarette block 23. In the region of the path of movement of the filling piece 39, the carrier 85 is provided with a carrier surface 92 which is offset to the rear with respect to the conveying direction. This carrier surface 92 engages the filling piece 39 during transport in a rearwardly offset position relative to the cigarette block 23. Only when the folding tabs 91 are folded or thereafter, the filling piece 39 is moved to its proper pack position by means of a displacement relative to the cigarette block 23. In this position, the filling piece 39 is flush with the limitation (bottom side) of the cigarette block 23 which is lying in front with respect to the conveying direction.

What is claimed is:

1. A process for producing filling pieces, from thin cardboard blanks, for cigarette packs which have a top cavity therein after being filled with cigarettes to form a completed pack, a) wherein each blank (40) has a rectangular filling piece wall (41), oppositely situated side panels (42, 43) a cross-panel (44) which is located at the top in the completed pack and which is directed transversely relative to the filling piece wall (41) and the side panels (42, 43), and corner tabs (45, 56) which are connected to the cross-panel (44) and extend as an extension of the side panels (42, 43), and wherein said process comprises the following steps:

b) separating the corner tabs (45, 56) from the side panels (42, 43) by severing cuts (47), and folding the corner tabs (45, 56) to a position transverse to the cross-panel (44);

c) then, folding the cross-panel (44) with the corner tabs (45, 56) to a position transverse to the filling piece wall (41); and d) then, folding the side panels (42, 43) to a position transverse to the filling piece wall (41) further comprising the following steps:

first, folding the tabs (45, 56) together with the side panels (42, 43) to an intermediate folding position that is inclined relative to the filling piece wall (41), and then further folding only the tabs (45, 46) to said position transverse to the cross-panel (44); and after the cross-panel (44) has been folded, folding the side panels (42, 43) from the inclined intermediate position to said position transverse to the filling piece wall (41).

2. An apparatus for producing filling pieces for cigarette packs, each completed filling piece (39) consisting of a folded blank (40) which is made of thin cardboard and which has side panels (42, 43) folded transverse to a filling piece wall (41), at least an upper cross-panel, and corner tabs (45, 46) adjoining the cross-panel (44) and resting parallel to the side panels (42, 43), said apparatus comprising:

a) means for moving a flat blank (40) in a folding shaft (57) along a path of movement relative to stationary folding means;

b) folding means comprising inclined first folding surfaces (62, 63) for obliquely folding the side panels (42, 43) and the corner tabs (45, 46) to an inclined position wherein said folding means are disposed in said folding shaft (57) in the direction of movement of the blank (40) and in spaced relationship with the filling piece wall (41);

c) upright side faces (67, 68), located downstream of said first folding surfaces (62, 63) in the direction of movement of the blank, for further folding the corner tabs (45, 56) beyond the inclined position and to a position transverse to the cross-panel (44);

d) a transversely directed second folding surface (69), downstream of said upright side faces (67, 68), for folding the cross-panel (44) with the corner tabs (45, 56) to a position transverse to the filling piece wall (41); and e) third folding surfaces (70, 71), downstream of said second folding surface (69), for completing the folding of the side panels (42, 43) to the position transverse to the filling piece wall (41).

3. An apparatus as claimed in claim 2, wherein the folding means are inclined folding surfaces (62, 63; 69; 70, 71) which effect an increasing reduction of the cross-section of the folding shaft (57) in the direction of movement and therewith cause the side panels (42, 43) and cross-panel (44) to fold over.

4. The apparatus as claimed in claim 2 or 3, wherein the blank (40) is movable through the folding shaft (57), in upward direction, by means of a stamp (59) with a lifting plate (58), with the portions of the blank (40) which are to be folded projecting from said lifting plate (58).

5. The apparatus as claimed in claim 4, wherein the blank (40) is movable by the stamp (59) with the lifting plate (58) up to the plane of a discharge track (78) and is supportable in an end position on oppositely situated supporting edges (76, 77).

6. The apparatus as claimed in claim 2, wherein, next to said upright side faces (67, 68), the first folding surfaces (62, 63) are adjoined by laterally directed indentations (64, 65) for receiving the obliquely folded side panels (42, 43) while the corner tabs (45, 56) are folded further.

7. The apparatus as claimed in claim 2 or 6, wherein said upright side faces (67, 68) adjoin first folding surfaces (62, 63) that are appropriately extended next to said upright side faces (67, 68).

* * * * *